US006761222B2

(12) United States Patent
Wilson

(10) Patent No.: US 6,761,222 B2
(45) Date of Patent: Jul. 13, 2004

(54) PACKER SYSTEM

(75) Inventor: James Brain Wilson, North Somerset (GB)

(73) Assignee: ABB Offshore Systems Limited, Nailsea (GB)

( * ) Notice: Subject to any disclaimer, the term of this patent is extended or adjusted under 35 U.S.C. 154(b) by 0 days.

(21) Appl. No.: 10/220,168

(22) PCT Filed: Feb. 5, 2001

(86) PCT No.: PCT/GB01/00457

§ 371 (c)(1),
(2), (4) Date: Aug. 28, 2002

(87) PCT Pub. No.: WO01/66906

PCT Pub. Date: Sep. 13, 2001

(65) Prior Publication Data

US 2003/0034163 A1 Feb. 20, 2003

(30) Foreign Application Priority Data

Mar. 4, 2000 (GB) ..... 0005183

(51) Int. Cl.[7] ..... E21B 33/127
(52) U.S. Cl. ..... 166/387; 166/187
(58) Field of Search ..... 166/387, 187, 166/191, 250, 312, 386

(56) References Cited

U.S. PATENT DOCUMENTS

| | | | | |
|---|---|---|---|---|
| 4,230,180 A | | 10/1980 | Patton et al. | |
| 4,467,865 A | | 8/1984 | Hardymon | |
| 4,643,024 A | | 2/1987 | Kovari et al. | |
| 4,655,286 A | | 4/1987 | Wood | |
| 5,267,617 A | * | 12/1993 | Perricone et al. | 166/387 |
| 5,297,633 A | * | 3/1994 | Snider et al. | 166/387 |
| 5,366,020 A | * | 11/1994 | Berzin et al. | 166/387 |
| 5,404,946 A | * | 4/1995 | Hess | 166/187 |
| 6,192,982 B1 | * | 2/2001 | Divis et al. | 166/187 |
| 6,257,338 B1 | * | 7/2001 | Kilgore | 166/387 |

FOREIGN PATENT DOCUMENTS

| | | |
|---|---|---|
| GB | 2200386 | 8/1988 |
| GB | 2321076 | 7/1998 |
| GB | 2332225 | 6/1999 |

* cited by examiner

*Primary Examiner*—Frank Tsay
(74) *Attorney, Agent, or Firm*—Bracewell & Patterson, L.L.P.

(57) ABSTRACT

Packers are expandable sealing devices used to seal off zones in a well. Packers are expanded to seal the bore of the well by means of expansion fluid supplied via individual pipelines. However, packers near the top of the well have to accommodate all of the pipelines for packers below. The invention provides a packer system comprising a plurality of packers (22–28) and fluid delivery means arranged to supply fluid to the packers, to expand them in use. The fluid delivery means includes a common fluid pipeline (36) for the packers. Thus, only one expansion fluid pipeline has to pass through the upper packers (22, 23), irrespective of the overall number of packers in the system.

16 Claims, 4 Drawing Sheets

PACKER SYSTEM

Figure 1A:
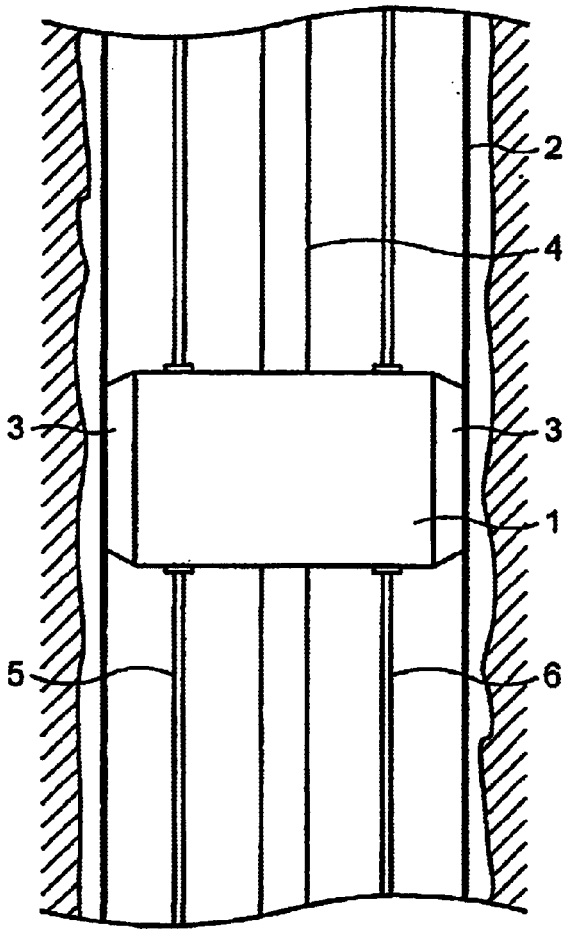

This invention relates to a packer system employed, for example, downhole in an oil or gas well.

Packers are expandable sealing devices, conventionally employed to seal off areas of a bore. A packer is usually cylindrical and is arranged to have, in its unexpanded state, a smaller diameter than the inner diameter of the bore of the tubing into which it is to be fitted. When a packer is passed downhole and reaches a desired location, it is made to expand by means of liquid or gas (otherwise known as expansion fluid), thereby providing a close seal against the bore. A packer system conventionally comprises a plurality of expandable packers and means for delivering expansion fluid to each of the packers. This expansion fluid delivery means usually takes the form of a plurality of pipelines known as fluid feed lines, one for each packer.

Packers are generally installed in a well in a sequence. The packers for lower regions of the well are installed first, and the rest are installed in turn, working upwards through the well.

A region of each packer is set aside to accommodate cables and tubing for the provision of downhole services to devices below the packer.

A problem which may be encountered with conventional packer systems is that, owing to the sequence of installation, packers at the top of the well are taken up with accommodating fluid feed lines for the packers below, thereby taking up space which could otherwise be used to provide downhole services.

The invention provides a packer system comprising a plurality of expandable packers and fluid delivery means arranged to supply fluid to the packers, to expand them in use, wherein the fluid delivery means includes a common pipeline for the packers.

The provision of a common pipeline, or fluid feed line, reduces the number of fluid feed lines passing through the upper packers. Therefore, more downhole services can be accommodated, if required.

Advantageously, each packer has a check valve arranged to open when the pressure of fluid in the common pipeline reaches a predetermined value. This enables the packers to be expanded in a controlled manner.

Preferably, the predetermined value at which each valve opens is different for each of the packers. This allows the packers to be expanded in sequence, which sequence can be determined by an operator of the system.

The packer system can also include devices arranged to prevent the packers from contracting after they have been expanded. These devices may be ratchet mechanisms or non-return valves, or a combination of both.

The common pipeline may be arranged to supply fluid to a downhole device actuator, after expansion of the packers. The actuator may have a valve arranged to open when the fluid in the pipeline reaches a predetermined value, which value is preferably greater than the working pressure of the actuator.

The invention further provides a method of installing a packer system, which system includes a plurality of expandable packers in predetermined locations, comprising supplying fluid to the packers, to expand them, via a common pipeline.

Figure 1B:
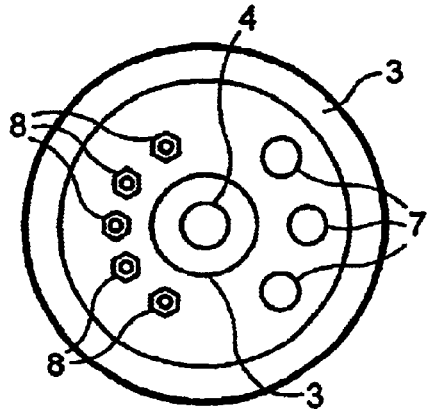

The invention will now be described, by way of example, with reference to the accompanying drawings, in which:

FIG. 1*a* is a partly sectional side view of a region of a bore including an expanded packer;

FIG. 1*b* is a plan view of the packer of FIG. 1*a;*

Figure 2:
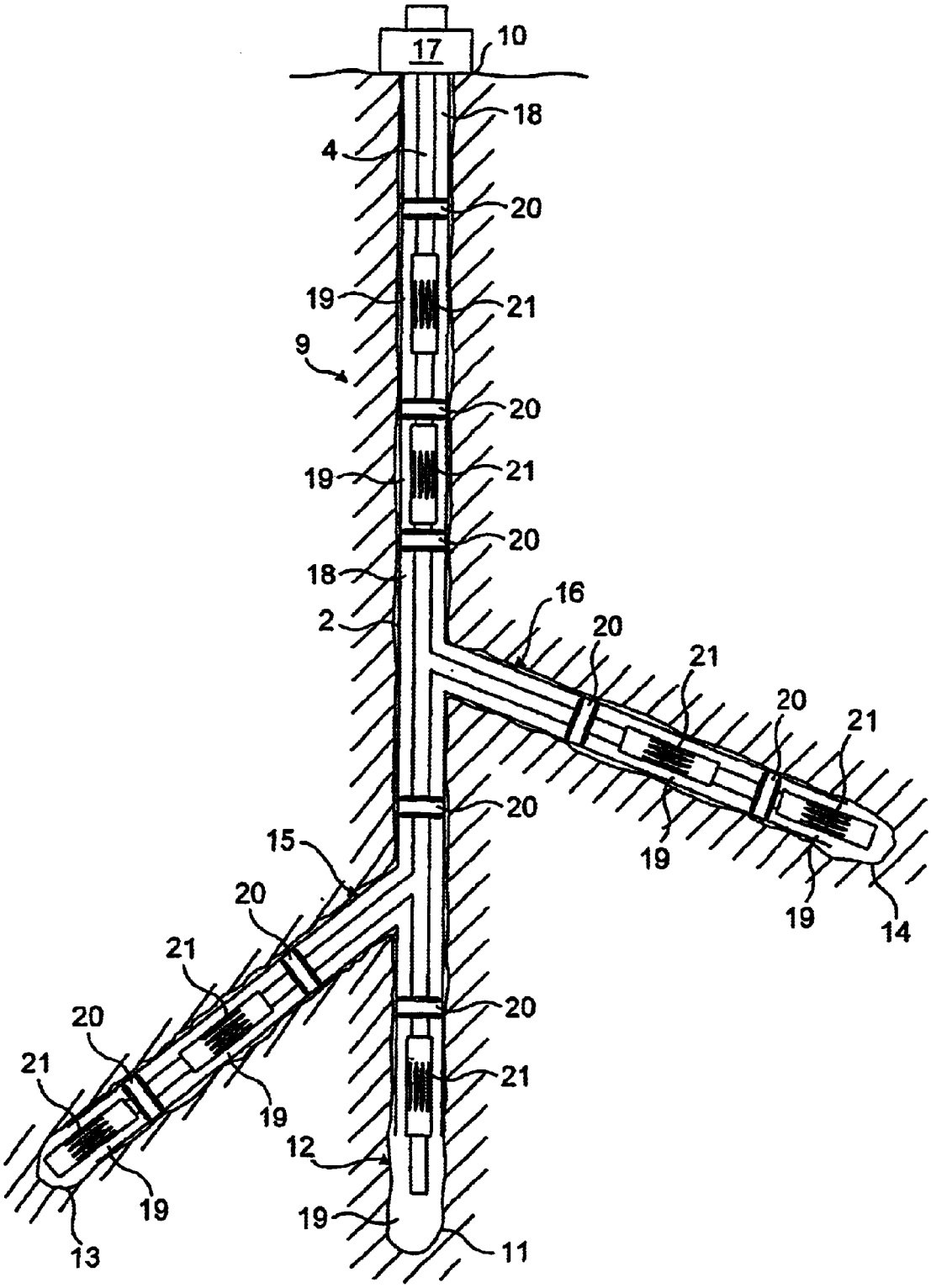
Figure 3:
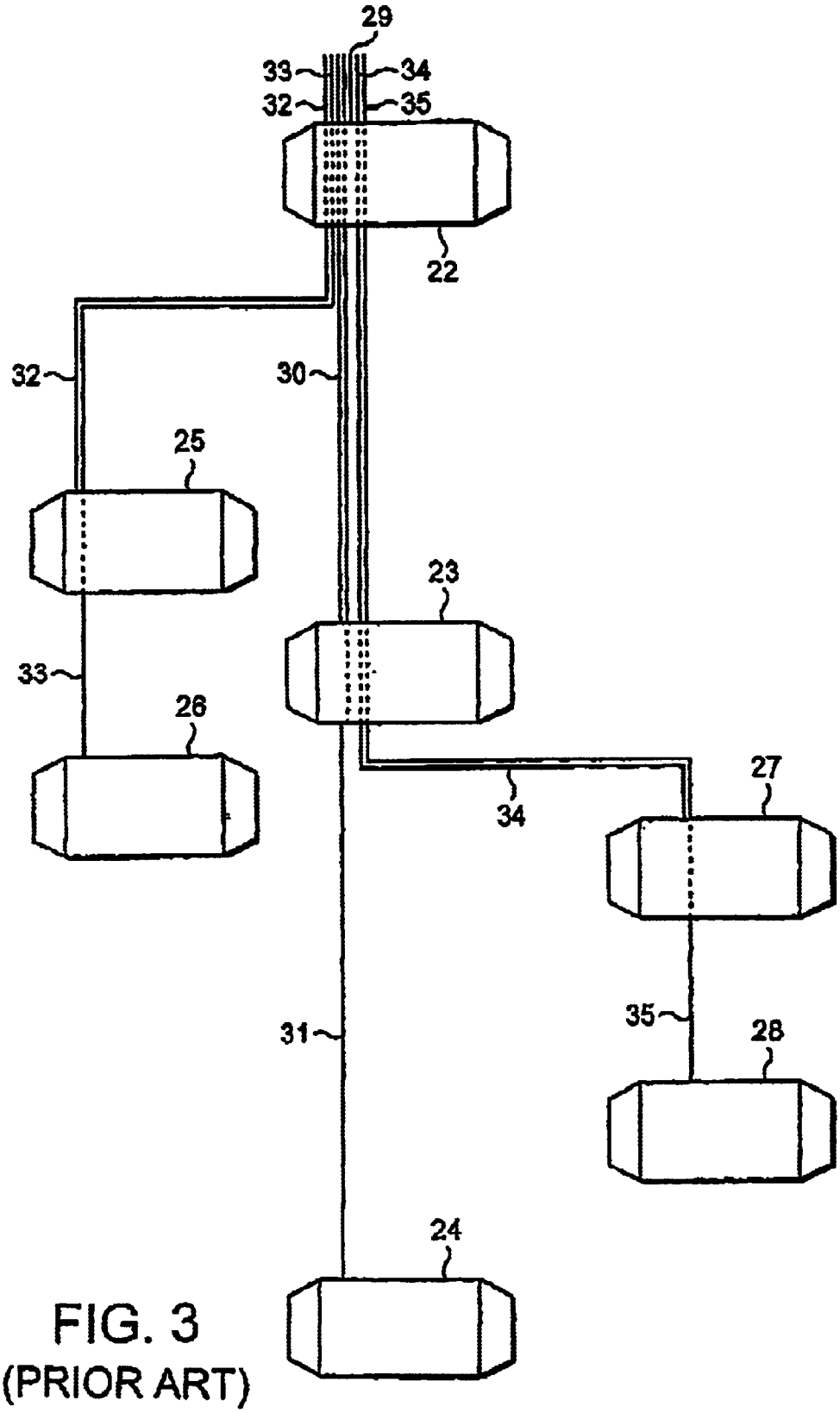
FIG. 3 (PRIOR ART)
Figure 4:
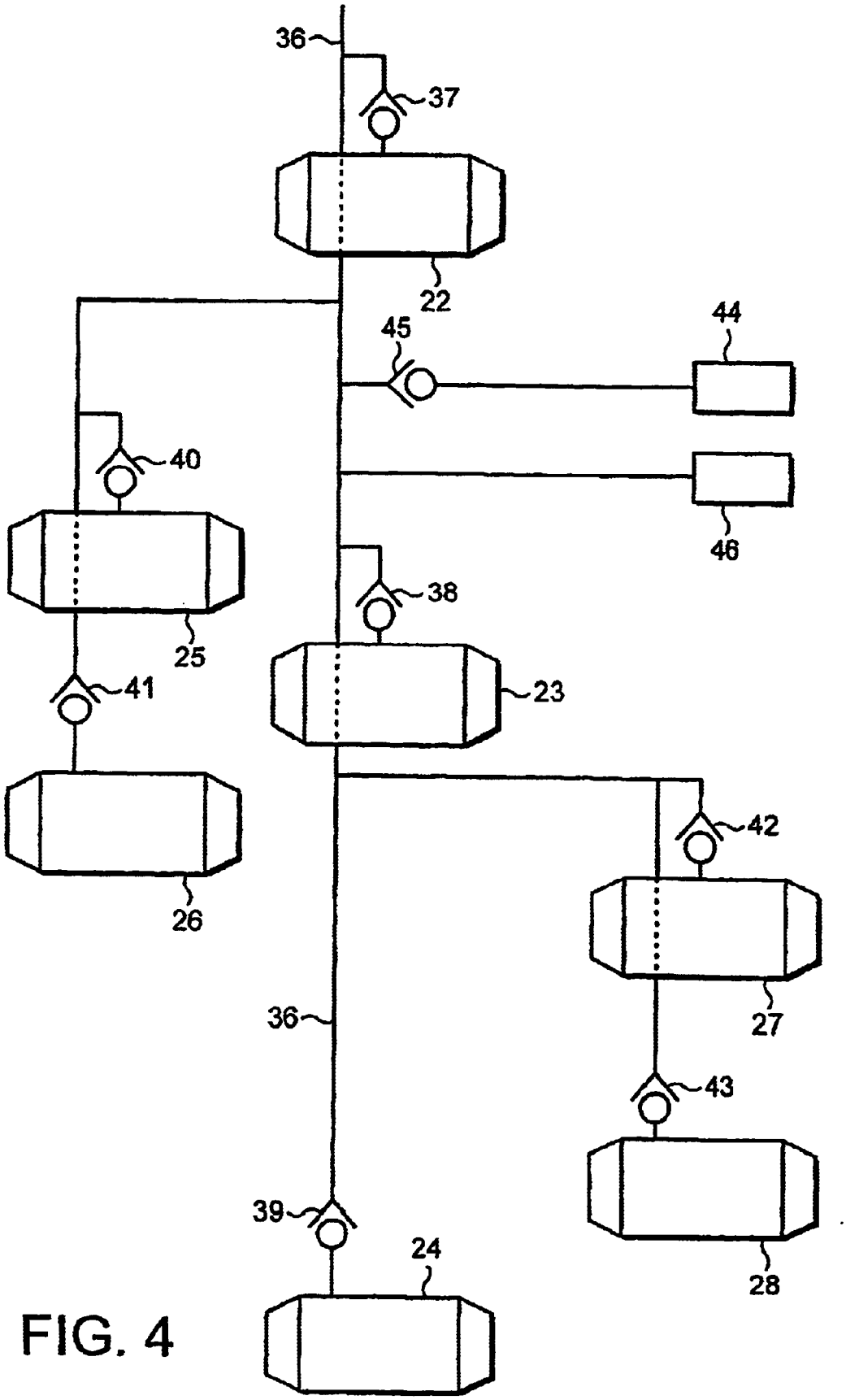

FIG. 2 is a sectional view of a typical well;

FIG. 3 schematically illustrates the fluid delivery arrangement of a conventional packer system; and FIG. 4 illustrates the fluid delivery arrangement of a packer system constructed according to the invention.

Like reference numerals have been applied to like parts throughout the specification.

With reference to FIGS. 1*a* and *b*, an expanded packer 1 is shown in a oil well casing 2. The packer 1 includes an expansion piece 3 which has been expanded to bring its outer surface into intimate contact with the inner surface of the casing 2. The packer 1 is ring-shaped and its inner surface expands to engage with the outer surface of production tubing 4. An important feature of a packer is that it must accommodate cables and lines for the provision of downhole services for devices below the packer. For example, in FIG. 1*a*, an hydraulic fluid line 5 and an electric cable 6 are shown passing through the packer 1. The provision of such downhole services is confined to a limited region of the packer, as shown in FIG. 1*b*. A plurality of service feeds is shown in this drawing, namely fluid service feeds 7 and electrical service feeds 8. It will be appreciated that such feeds can only be accommodated in the non-expandable part of the packer.

A diagrammatic representation of a known well is shown in FIG. 2. This shows a bore 9 lined with the casing 2 which contains the production tubing 4. The casing 2 extends from the surface 10 to the end region 11 of the main bore 12. The casing 2 also extends to the end regions 13, 14 of lateral bores 15, 16, running off the main bore 12. The surface 10 of the well may be the seabed. The casing 2 supports a tubing hanger 17 which, in turn, supports the production tubing 4. The casing 2 and production tubing 4 are separated by a space 18 which is referred to as an annulus. The annulus 18 serves a number of purposes, for example it can be used to detected fluid leakage from the production tubing 4.

Along the extent of the bore 9 are a number of hydrocarbon-bearing zones 19 from which hydrocarbons such as oil and gas are extracted. It is important to isolate the hydrocarbon-bearing zones 19 from non-hydrocarbon bearing zones. If these zones contain aquifer layers, from which water is extracted, allowing communication between the aquifer layers and the hydrocarbon-bearing zones can cause contamination. Therefore, the annulus is divided into compartments divided by packers 20 which prevent transfer of material between hydrocarbon-bearing zones and non-hydrocarbon bearing zones occurring along the annulus 18.

Hydrocarbons present in the zones may be at different pressures. If the pressures are considerably different, hydrocarbons could flow from one zone to another, rather than up the production tubing if there is unrestricted communication between the zones. For this reason, variable chokes 21 are provided to restrict flow from the hydrocarbon bearing zones 19 into the production tubing 4.

FIG. 3 illustrates a simplified conventional packer system. All other features of the well have been omitted from this drawing for clarity. The packer system comprises a plurality of packers 22–28, shown here in expanded form, and fluid feeds 29–35 for the respective packers. Packers 22–24 are intended to represent packers located in the main bore of the well. Packers 25–28 represent packers located in lateral bores running off the main bore.

Packers 24, 26 and 28 are located in the lower regions of their respective bores, and, as such, only need to accommodate their own fluid feed lines 31, 33 and 35 respectively.

However, packer 25 has to accommodate its own fluid feed line 32 and also allow the feed line 33 for packer 26, located below it, to pass through. Similarly, packer 27 has to accommodate its own fluid feed line 34 and also allow the feed line 35 for packer 28 to pass through. Packer 23 has its own fluid feed line 30 and also allows the feed lines for packers 24, 27 and 28 to pass through it. Packer 22 accommodates its own fluid feed line 29 and fluid feed lines 30–35 for all the other packers located below it; a total of six feed lines pass through this packer.

Therefore, the upper packers of the well have a substantial number of expansion fluid feed lines, but must also accommodate as many downhole service feeds as may be required by downhole devices. This increases both the cost and complexity of the packer system.

A packer system constructed in accordance with the invention is shown in FIG. 4. This drawing shows the same configuration of packers 22–28 as in FIG. 3, that is to say packers 22–24 in the main bore and packers 25–28 in the lateral bores. In accordance with the invention, the expansion fluid delivery system includes a common fluid feed line 36 for all the packers. The common fluid feed line 36 extends to the lowest packer 24 in the main bore and branches off at predetermined locations along its length in order to provide fluids to packers 25–28 in the lateral bores.

Thus, only one expansion fluid feed line is required to pass through the upper packers, irrespective of the overall number of packers employed down the well.

The fluid is fed to the packers 22–28 via associated check valves 37–43. Each check valve is preset to open at a different pressure, and usually the check valve 39 associated with the lowest packer 24 in the well is preset to the lowest pressure of all the check valves in the packer system. The check valve 43 associated with the next highest packer 28 is preset at a higher pressure value than the first check valve 39. This is continued through all the packers with the check valve 37 associated with the highest packer 22 being preset to open at the highest pressure value of all the check valves in the packer system.

The method of expanding the packers is as follows. The pressure of the expansion fluid in the common pipeline 36 is raised until it exceeds the opening preset pressure of valve 39 associated with the lowest packer in the system. Thus, the valve opens and the packer 24 expands and seals to the casing. This seal is then tested and, when proven satisfactory, the expansion fluid pressure is raised further until it exceeds the preset pressure of check valve 43 associated with the next highest packer 28, whereby packer 28 then expands and seals to the casing. This seal would then be tested and the expansion fluid pressure raised further to expand the next packer in the sequence. The process of increasing the expansion fluid pressure in steps to expand each packer in turn, with testing in between, is continued until all of the packers have been expanded and tested.

Generally the order of expansion of the packers and testing for successful sealing is effected, as in the aforementioned example, in a sequence starting with the lowest packer in the system and finishing with the highest packer. However, it is a further advantage of the present invention that this process is not restricted to this order. Any sequence of expansion of the packers can be accommodated, by presetting the appropriate check valves to the required opening pressures, in the order of the required sequence. It will be appreciated that, in the prior art system, the lower packers were of necessity installed and expanded first.

After the packers have all been expanded and tested, the expansion fluid feed line 36 may not be used again, as packers usually have some mechanism such as a ratchet to retain the expansion of the packer. Alternatively, sustenance of the fluid pressure in each packer may be effected by means of a non-return valve. Thus, the need to sustain the pressure in the expansion fluid feed line 36 may not be required. It is an additional feature of the invention that, after installation of the packers, the expansion fluid feed line 36 can be used for other purposes. For example, the fluid feed line 36 could be used to deliver control fluid to actuate a downhole device involved with, for example, the well output or oil/gas control. An actuator associated with such a downhole device is indicated in this drawing by reference numeral 44. This secondary use of the fluid line 36 may be achievable when the preset pressure of the check valve 37 feeding the uppermost packer 22 in the sequence of packers is set to be greater than the working pressure of the actuator 44 associated with the downhole device. It follows that the downhole device actuator 44 must also be able to survive the highest pressure required to expand the last packer in the system during installation.

Alternatively, the control fluid supplied to a downhole device actuator can be fed via another check valve 45, preset to a pressure higher than the preset pressure of the check valve associated with the last packer of the sequence. It follows that all the packers and the downhole device actuator must be able to survive this higher pressure.

A further alternative that this invention permits is to operate two downhole device actuators 44, 46 from the expansion fluid feed line 36 after installation, in circumstances where one device actuator must be operated prior to the other. Likewise, more than two downhole device actuators could be operated from the expansion fluid feed line 36 if each was fed in sequence via a respective check valve, with the valves being preset to open at a higher pressure than the previous check valve in the sequence.

What is claimed is:

1. A packer system for use within a wellbore, comprising a plurality of expandable packers and fluid delivery means arranged to supply fluid to the packers, to expand them in use so that they are capable of engaging the interior of a casing of the bore, wherein the fluid delivery means includes a common fluid pipeline for the packers, the packers further comprising means for separately accommodating at least one further line for the provision of downhole services.

2. A packer system as claimed in claim 1, wherein each packer includes a valve arranged to open when pressure of the fluid in the common pipeline reaches a predetermined value.

3. A packer system as claimed in claim 2, wherein the valves are arranged to open when the pressure of the fluid in the common pipeline reaches different respective predetermined values.

4. A packer system for use within a wellbore, comprising a plurality of expanded packers capable of engaging the interior of a casing of the bore, the packers having a common fluid pipeline and having been expanded by fluid delivered via the common pipeline, the packers further comprising means for separately accommodating at least one further line for the provision of downhole services.

5. A packer system as claimed in claim 4, further comprising means arranged to prevent contraction of the packers when expanded.

6. A packer system as claimed in claim 5, wherein the means to prevent contraction of the packers includes a non-return valve.

7. A packer system as claimed in claim 5, wherein the common pipeline is arranged to be capable of delivering fluid to a first actuator for a device.

8. A packer system as claimed in claim 7, further comprising a valve for the actuator, the valve being arranged to open when fluid in the pipeline reaches a first predetermined value.

9. A packer system as claimed in claim 8, wherein the predetermined pressure value is arranged to be greater than the working pressure of the actuator.

10. A packer system as claimed in claim 8, further comprising a second actuator having a valve arranged to open when fluid in the pipeline reaches a second predetermined value, the second predetermined value being different from the first predetermined value.

11. A well including a packer system as claimed in claim 7.

12. A packer system comprising a plurality of expandable packers and fluid delivery means arranged to supply fluid to the packers, to expand them in use, wherein the fluid delivery means includes a common fluid pipeline for the packers;

means arranged to prevent contraction of the packers when expanded; and wherein the means to prevent contraction of the packers includes a ratchet mechanism.

13. A method of installing a packer system within a wellbore, the packer system including a plurality of expandable packers in predetermined locations, the method comprising supplying fluid to the packers, to expand them so that they are capable of engaging the interior of a casing of the wellbore, via a common pipeline, the packers comprising means for separately accommodating at least one further line for the provision of downhole services.

14. A method as claimed in claim 13, wherein each packer includes a valve, the method further comprising setting each valve to open when the pressure of fluid in the common pipeline reaches a predetermined value.

15. A method as claimed in claim 14, further comprising arranging the valves to open when the pressure of fluid in the common pipeline reaches different respective predetermined values.

16. A method as claimed in claim 14, wherein the packers are expanded in a predetermined sequence.

* * * * *